US012678016B2

(12) United States Patent
Geng et al.

(10) Patent No.: US 12,678,016 B2
(45) Date of Patent: Jul. 14, 2026

(54) AIR EXHAUST DEVICE, AND DISH WASHING MACHINE

(71) Applicant: WUHU MIDEA SMART KITCHEN APPLIANCE MANUFACTURING CO., LTD., Wuhu (CN)

(72) Inventors: Jie Geng, Wuhu (CN); Xiqing Zhu, Wuhu (CN); Richao Liu, Wuhu (CN)

(73) Assignee: WUHU MIDEA SMART KITCHEN APPLIANCE MANUFACTURING CO., LTD., Wuhu (CN)

( * ) Notice: Subject to any disclaimer, the term of this patent is extended or adjusted under 35 U.S.C. 154(b) by 0 days.

(21) Appl. No.: 19/138,606

(22) PCT Filed: May 31, 2023

(86) PCT No.: PCT/CN2023/097608
§ 371 (c)(1),
(2) Date: Jun. 12, 2025

(87) PCT Pub. No.: WO2024/124819
PCT Pub. Date: Jun. 20, 2024

(65) Prior Publication Data

US 2026/0026672 A1 Jan. 29, 2026

(30) Foreign Application Priority Data

Dec. 12, 2022 (CN) ..... 202211599159.0
Dec. 12, 2022 (CN) ..... 202223359075.8
Dec. 12, 2022 (CN) ..... 202223360206.4

(51) Int. Cl.
*A47L 15/48* (2006.01)

(52) U.S. Cl.
CPC ..... *A47L 15/488* (2013.01); *A47L 15/486* (2013.01)

(58) Field of Classification Search
None
See application file for complete search history.

(56) References Cited

U.S. PATENT DOCUMENTS

2021/0015338 A1 1/2021 Buesing et al.

FOREIGN PATENT DOCUMENTS

CN 105816136 A 8/2016
CN 111728568 A 10/2020
(Continued)

OTHER PUBLICATIONS

International Search Report dated Aug. 31, 2023 issued in PCT/CN2023/097608.
Grant Notice dated Mar. 17, 2023 issued in CN 202223359075.8.

*Primary Examiner* — Rita P Adhlakha
(74) *Attorney, Agent, or Firm* — Scully, Scott, Murphy & Presser, P.C.

(57) ABSTRACT

Provided are an air exhaust device and a dish washing machine. The air exhaust device includes a housing and an adjustment mechanism. The housing has an air exhaust duct and a first air inlet in communication with the air exhaust duct. The first air inlet is in communication with an inner tub of a dish washing machine. The adjustment mechanism includes an adjuster and a driver driving and connected to the adjuster. The adjuster is movable towards or away from the first air inlet driven by the driver, and the adjuster has a first end and a second end that are spaced apart from each other. When the adjuster moves towards the first air inlet and the first end abuts with the first air inlet, the second end continues to move towards the first air inlet to elastically deform the adjuster to block the first air inlet.

19 Claims, 12 Drawing Sheets

(56) References Cited

FOREIGN PATENT DOCUMENTS

| | | | |
|---|---|---|---|
| CN | 215838912 | U | 2/2022 |
| CN | 218922501 | U | 4/2023 |
| CN | 218922502 | U | 4/2023 |
| CN | 218922503 | U | 4/2023 |
| CN | 218922504 | U | 4/2023 |
| WO | 2015169086 | A1 | 11/2015 |

AIR EXHAUST DEVICE, AND DISH WASHING MACHINE

CROSS-REFERENCE TO RELATED APPLICATIONS

This application is a National Stage Entry under 35 U.S.C. § 371 of PCT International Application No. PCT/CN2023/097608 filed on May 31, 2023, which claims priorities to Chinese patents application Nos. 202211599159.0, 202223359075.8, and 202223360206.4, all titled "AIR EXHAUST DEVICE AND DISH WASHING MACHINE", and all filed with China National Intellectual Property Administration on Dec. 12, 2022, the entire contents of each of which are incorporated herein by reference for all purposes.

FIELD

The present disclosure relates to the field of dish washing machine technologies, and particularly, to an air exhaust device, and a dish washing machine.

BACKGROUND

When a dish washing machine is in a washing state, an inner tub is in a high-temperature and high-humidity environment. After the washing is completed, dishes in the inner tub need to be dried. In the related art, an air exhaust device is provided to extract air from the inner tub during a drying stage, thereby drying the dishes.

SUMMARY

The present disclosure aims to solve one of the technical problems in the related art at least to some extent. To this end, the present disclosure provides an air exhaust device. The air exhaust device effectively prevents entry of steam when a dish washing machine is in a washing stage.

To achieve the above object, the present disclosure discloses an air exhaust device. The air exhaust device includes a housing and an adjustment mechanism.

The housing has an air exhaust duct and a first air inlet in communication with the air exhaust duct. The first air inlet is in communication with an inner tub of a dish washing machine.

The adjustment mechanism includes an adjuster and a driver driving and connected to the adjuster. The adjuster is movable towards or away from the first air inlet driven by the driver, and the adjuster has a first end and a second end that are spaced apart from each other. When the adjuster moves towards the first air inlet and the first end abuts with the first air inlet, the second end continues to move towards the first air inlet to elastically deform the adjuster to block the first air inlet.

In some embodiments of the present disclosure, the adjuster, along its length direction, is elastically deformed in a process of blocking the first air inlet by the adjuster.

In some embodiments of the present disclosure, the first end abuts with the first air inlet before the second end abuts with the first air inlet in the process of blocking the first air inlet by the adjuster.

In some embodiments of the present disclosure, the adjuster has a contact portion driven by and connected with the driver. The first end and the second end are located at one side of the contact portion, and the second end is closer than the first end to the contact portion.

In some embodiments of the present disclosure, an angle is formed between an extending direction of the adjuster and an extending direction of the first air inlet upon the adjuster being in contact with the first air inlet.

In some embodiments of the present disclosure, the driver is configured to drive the adjuster to rotate.

In some embodiments of the present disclosure, the adjuster is provided with a gear portion. The driver includes a motor and a worm. The motor is configured to drive the worm to rotate, and the worm is configured to drive the adjuster to rotate by meshing with the gear portion.

In some embodiments of the present disclosure, a rotation axis of the motor formed when the motor is operated is coaxial with a rotation axis of the worm.

In some embodiments of the present disclosure, the worm is disposed at the housing. One of the worm and the housing has a limit groove; and the other one of the worm and the housing is provided with a limit protrusion. The limit protrusion is engaged into the limit groove to restrict a movement of the worm in an axial direction of the worm.

In some embodiments of the present disclosure, the gear portion is rotatably connected to the housing.

In some embodiments of the present disclosure, one of the gear portion and the housing is provided with a rotatory shaft; and the other one of the gear portion and the housing has a shaft hole. The rotatory shaft is engaged into the shaft hole. In some embodiments of the present disclosure, the housing includes a first half housing and a second half housing connected to the first half housing. At least part of the air exhaust duct being formed by the first half housing and the second half housing. The adjuster and the driver are disposed between the first half housing and the second half housing.

In some embodiments of the present disclosure, the housing further has a second air inlet in communication with the air exhaust duct. The second air inlet is configured to introduce external air. The adjuster is movable towards the first air inlet and the second air inlet under the driving of the driver. The air exhaust device further includes an air blower disposed in the air exhaust duct.

In some embodiments of the present disclosure, the adjuster includes a blocker and a seal portion disposed at the blocker. The blocker is driven by and connected with the driver. The seal portion has a contact surface. In a process of blocking the first air inlet by the adjuster, the contact surface abuts with an edge of the first air inlet, and the blocker and/or the seal portion are elastically deformed.

In some embodiments of the present disclosure, the seal portion includes an inner layer and an outer layer. A cavity is formed between the inner layer and the outer layer. The inner layer is fixed to the blocker. The outer layer has the contact surface.

In some embodiments of the present disclosure, an opening in communication with the cavity is formed between the inner layer and the outer layer. The opening is oriented to face away from the first air inlet.

In some embodiments of the present disclosure, one of the blocker and the inner layer has a recess, and the other one of the blocker and the inner layer is provided with a protrusion. The protrusion is engaged into the recess.

In some embodiments of the present disclosure, the blocker has a through groove. The inner layer is constructed into an annular structure and provided with a connecting rod portion. The connecting rod portion is located within a space enclosed by the inner layer. The connecting rod portion is engaged into the through groove.

In some embodiments of the present disclosure, the seal portion and the blocker are formed by two-shot injection molding.

In some embodiments of the present disclosure, the housing further has a second air inlet in communication with the air exhaust duct. The second air inlet is configured to introduce external air. The adjuster is movable towards the first air inlet and the second air inlet under the driving of the driver. The air exhaust device further includes an air blower disposed in the air exhaust duct.

The present disclosure also discloses a dish washing machine. The dish washing machine includes the air exhaust device described in any of the above embodiments.

BRIEF DESCRIPTION OF THE DRAWINGS

In order to clearly explain technical solutions of embodiments of the present disclosure or in the related art, drawings used in the embodiments are briefly described below. The drawings as described below merely illustrate some embodiments of the present disclosure. Based on structures shown in these drawings, other designs can be obtained by those skilled in the art without creative effort.

Figure 1:
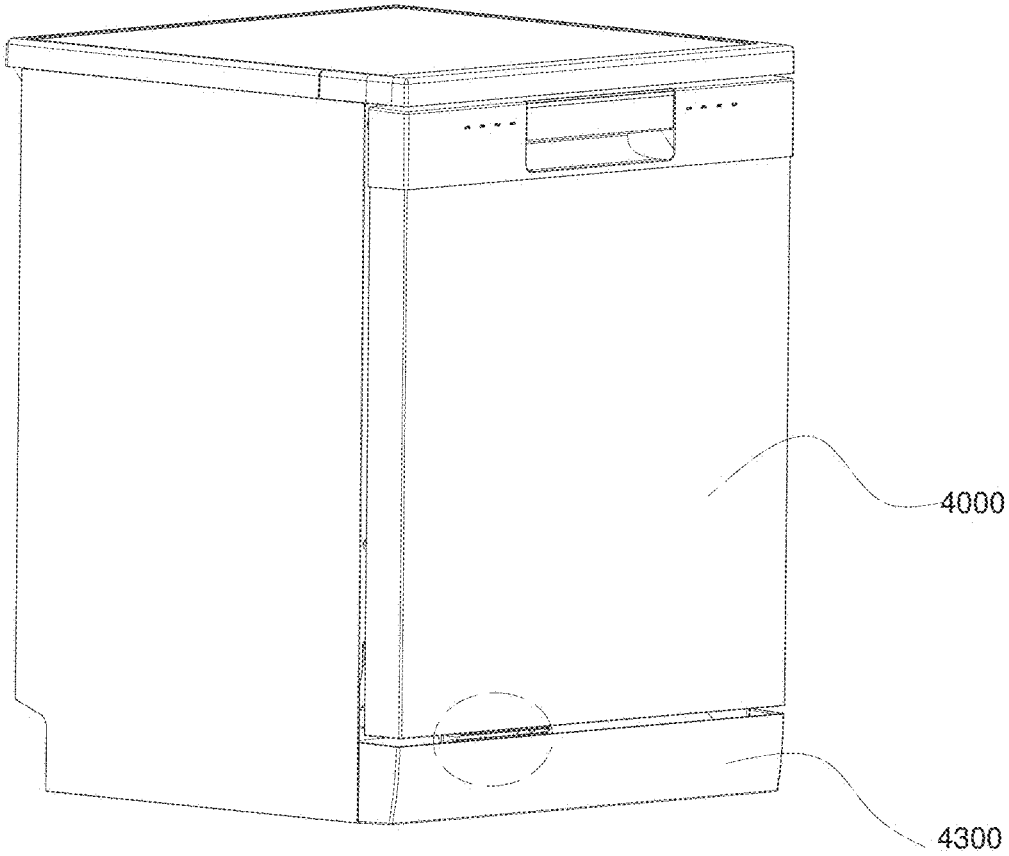
FIG. 1 is a perspective view of a dish washing machine according to some embodiments.
Figure 2:
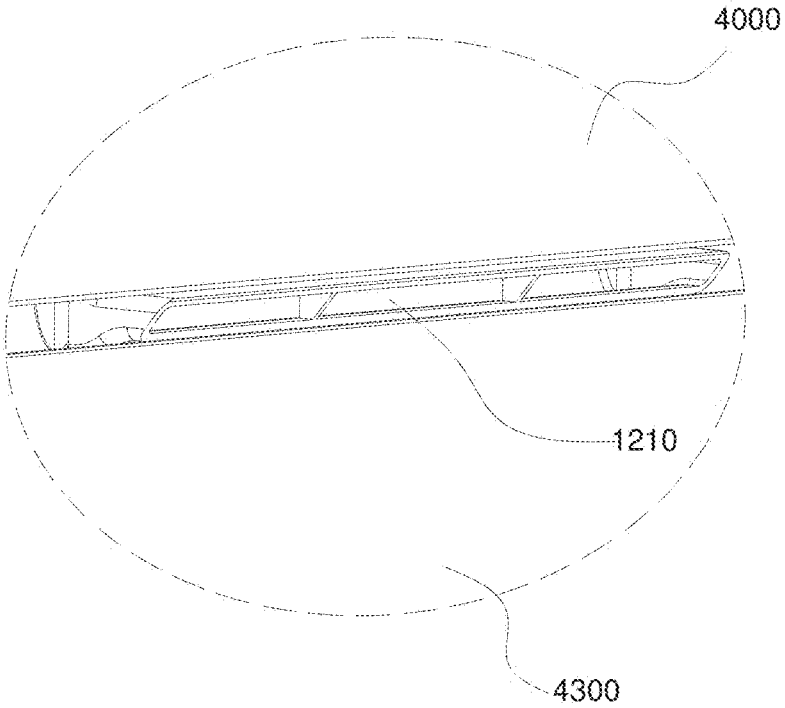
FIG. 2 is an enlarged view of the part shown by the dotted line in FIG. 1.
Figure 3:
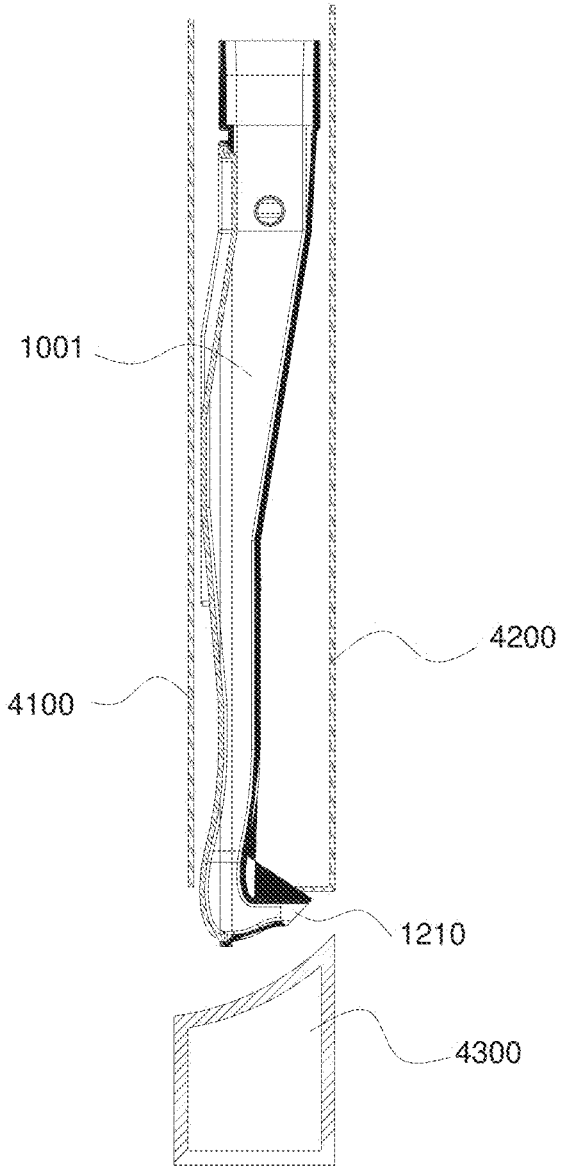
FIG. 3 is a schematic view of an air exhaust device mounted to a door according to some embodiments (only a part of the air exhaust device is shown).
Figure 4:
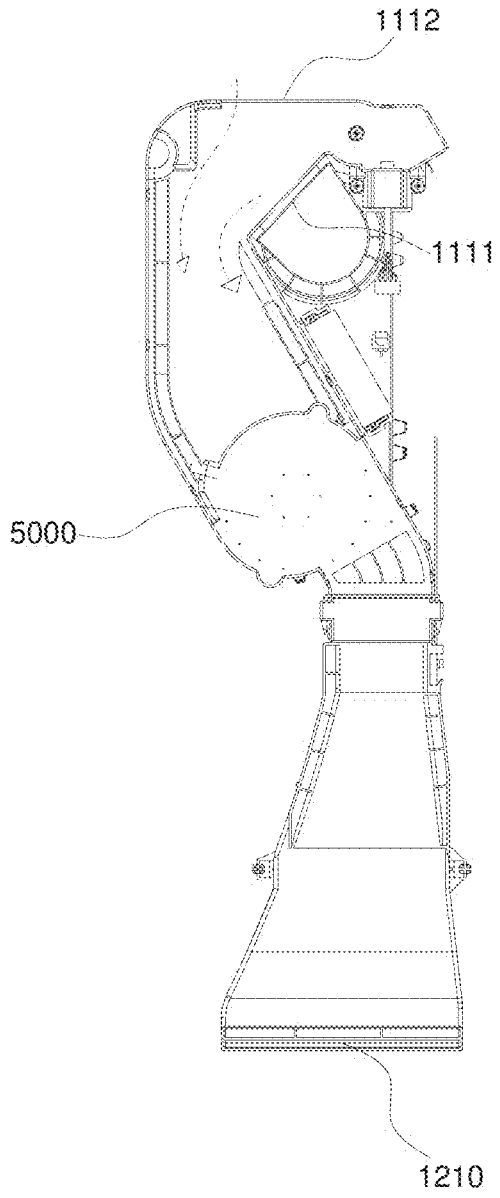
FIG. 4 is a schematic view of an air exhaust device according to some embodiments.

DESCRIPTION OF REFERENCE NUMBERS housing 1000, air exhaust duct 1001, limit protrusion 1002, rotary shaft 1003, first housing 1100, first half housing 1110, second half housing 1120, first air inlet 1111, second air inlet 1112, inner wall 1113, outer wall 1114, edge 1115 of the first air inlet, second housing 1200, air outlet 1210;

adjuster 2000, first end 2001, second end 2002, blocker 2100, recess 2110, through groove 2120, gear portion 2200, shaft hole 2210, seal portion 2300, inner layer 2310, protrusion 2311, connecting rod portion 2312, outer layer 2320, contact surface 2321, cavity 2330, opening 2331:

driver 3000, motor 3100, power output shaft 3110, worm 3200, limit groove 3210;

door 4000, inner door 4100, outer door 4200, skirting board 4300;

air blower 5000.

Realization of the objects, functional features, and advantages of the present disclosure will be further described with reference to the embodiments and the drawings.

DETAILED DESCRIPTION OF THE EMBODIMENTS

Technical solutions according to embodiments of the present disclosure will be described clearly and completely below with reference to the accompanying drawings of the embodiments of the present disclosure. Obviously, the embodiments described below are only a part of the embodiments of the present disclosure, rather than all embodiments of the present disclosure. On a basis of the embodiments of the present disclosure, all other embodiments obtained by those skilled in the art without creative labor shall fall within the protection scope of the present disclosure.

It should be noted that all directional indications (such as up, down, left, right, front, back . . . ) in the embodiments of the present disclosure are only used to explain a relative positional relationship, movement, etc., between components in a specific posture (as shown in the drawings), and the directional indication will also change correspondingly if the specific posture changes.

In the description of the embodiments of the present disclosure, unless specified or limited otherwise, the technical terms "connected", "fixed", etc., are understood broadly, such as a fixed connection or a detachable connection or connection as one piece: mechanical connection or electrical connection: direct connection or indirect connection through an intermediate; internal communication of two components or interaction relations between two components. For those skilled in the art, the specific meaning of the above-mentioned terms in the embodiments of the present disclosure can be understood according to specific circumstances.

In addition, terms such as "first", "second", etc., are used herein for purposes of description and are not intended to indicate or imply relative importance or significance. Furthermore, the feature defined with "first", and "second" may comprise one or more this feature distinctly or implicitly. In addition, the technical solutions in each embodiment may be combined with each other, but the combinations must be feasible to those of ordinary skill in the art. When the combination of technical solutions leads to inconsistencies or becomes unfeasible, such combination shall be deemed nonexistent and, therefore, not within the protection scope claimed in the present disclosure.

An air exhaust device will be described in detail in conjunction with a dish washing machine.

A dish washing machine is a device that can automatically wash tableware. Generally speaking, a dish washing machine includes a base, an inner tub, and a door. The inner tub is mounted on the base. The inner tub has a washing chamber. The door is rotatably connected to the inner tub and/or the base to allow the washing chamber to be closed or opened. The washing chamber is provided with a bowl basket that is capable of being pulled out or pushed in. When the washing chamber is opened, the bowl basket may be pulled out of the washing chamber by a user. At this time, the user may load the tableware on the bowl basket. After the loading is completed, the bowl basket is pushed into the washing chamber. Then, the door is rotated to close the washing chamber. In this way, washing is performed in the washing chamber.

A spray arm is provided in the washing chamber. The spray arm is in communication with an outlet of a washing pump of the base via a water channel, and the inlet of the washing pump is in communication with a water cup. The water cup is in communication with the washing pump, and water in the washing chamber may flow to the water cup. When the dish washing machine starts operating, a water inlet valve of the dish washing machine is opened, and water flows into the washing chamber. When a water level in the washing chamber reaches a predetermined water level, the water inlet valve is closed to cut off the continued input of water. The dish washing machine controls the washing pump to start, and the washing pump draws the water from the water cup and delivers the water to the spray arm. The spray arm is provided with a nozzle, and the water is ejected from the nozzle of the spray arm under pressure. Reverse driving force of the water jets ejected from the nozzle of the spray arm causes the spray arm to rotate. In this way, the water jets are sprayed onto the tableware to clean the tableware. The water jets ejected from the spray arm falls back into the washing chamber and then flows to the water cup. The water cup is provided with a filter. After being filtered by the filter, the water jets are recirculated by the washing pump until the current washing sequence ends.

In order to improve a cleaning effect of the tableware, generally speaking, it is necessary to heat the water during the washing sequence. For example, a heating component is provided in the washing pump. When the washing pump draws the water from the washing chamber, it heats the water synchronously. That is, the water jets ejected from the spray arm has a higher temperature, thereby improving the cleaning effect of the tableware.

After the washing stage is completed, the tableware needs to be dried. Since the washing chamber of the inner tub is in a high-temperature and high-humidity environment after the washing stage is completed, an air exhaust device is provided in the dish washing machine in the related art. The air exhaust device has a first air inlet in communication with the inner tub, i.e., with the washing chamber. The air exhaust device is configured to draw the air from the inner tub and discharge the air outside the dish washing machine. In this way, a temperature and humidity of the air in the washing chamber is reduced to allow for the drying of the tableware. It can be understood that an air blower is provided in the air exhaust device. When the air blower is operated, the air exhaust device draws the air from the inner tub, and at the same time, external air is introduced into the inner tub. For example, the inner tub has a vent through which fresh air is introduced into the inner tub. In other embodiments of the present disclosure, other part of the inner tub is provided with the air blower configured to blow the air in the inner tub into an air exhaust duct.

As described above, it can be seen that when the dish washing machine is in the drying stage, it is necessary to control the air exhaust device to draw the air from the inner tub and exhaust the air. However, when the dish washing machine is in the washing stage, it is not desired that the air in the inner tub flow into the air exhaust device through the first air inlet and leak into an external environment, for the air in the inner tub during the washing stage has the higher temperature and humidity and poses a certain danger when leaked into the external environment.

To this end, the present disclosure discloses an air exhaust device. The air exhaust device may be disposed at any part of the dish washing machine, such as inside the dish washing machine, or outside the dish washing machine, as long as the drawing and the exhausting of the air from the inner tub can be realized. In addition, the dish washing machine is embedded into a cabinet during installation, with only a front side of the dish washing machine exposed. Even if the dish washing machine is not embedded into the cabinet but installed independently, objects are likely to be placed at a side of the dish washing machine. Therefore, in order to facilitate the air exhaust device to exhaust the drawn air to the outside of the dish washing machine, the air exhaust device may be mounted at the front side of the dish washing machine, that is, the air exhaust device is mounted in a door 4000.

The door 4000 includes an inner door 4100 and an outer door 4200 that are stacked together. The air exhaust device is fixedly mounted between the inner door 4100 and the outer door 4200 and extends in an up-down direction. The inner door 4100 has a through hole. The air exhaust device is in communication with the through hole via the first air inlet 1111 to draw the air from the inner tub and exhaust the air to the external environment via an air outlet 1210.

In an exemplary embodiment of the present disclosure, as shown in FIGS. 1 to 7, the air exhaust device includes a housing 1000 and an adjustment mechanism. The housing 1000 has an air exhaust duct 1001 and a first air inlet 1111. The first air inlet 1111 is in communication with the air exhaust duct 1001 and the inner tub. Thus, the air in the inner tub may enter the air exhaust duct 1001 from the first air inlet 1111, and then be transported to the external environment through the air exhaust duct 1001. It can be understood that in order to achieve the drawing of the air from the inner tub, an air blower 5000 is provided in the air exhaust duct. In addition, the housing 1000 further has an air outlet 1210 in communication with the air exhaust duct 1001, and the air is transported along the air exhaust duct 1001 and exhausted to the external environment through the air outlet 1210. For example, the air outlet 1210 is exposed below the door 4000, and is located above a skirting board 4300, and faces towards a front of the dish washing machine.

The adjustment mechanism includes an adjuster 2000 and a driver 3000. The adjustment mechanism may be mounted in the housing 1000, and the driver 3000 drives and is connected to the adjuster 2000, that is, the adjuster 2000 is movable under an action of the driver 3000. The driver 3000 drives the adjuster 2000 to move towards or away from the first air inlet 1111, that is, the adjuster 2000 has two movement states under the action of the driver 3000. The first movement state refers to the movement of the adjuster 2000 towards the first air inlet 1111, and therefore the first air inlet 1111 may be blocked. The second movement state refers to the movement of the adjuster 2000 away from the first air inlet 1111, and therefore the first air inlet 1111 may be opened. The adjuster 2000 may move towards the first air inlet 1111 during forward driving of the driver 3000, and the adjuster 2000 may move away from the first air inlet 1111 during reverse driving of the driver 3000. In an embodiment of the present disclosure, two drivers 3000 may be provided. One of the two drivers 3000 is configured to control the adjuster 2000 to move towards the first air inlet 1111, and the other one of the two drivers 3000 is configured to control the adjuster 2000 to move away from the first air inlet 1111.

When the air exhaust device is required to draw and exhaust the air from the inner tub, for example, when the dish washing machine is in a drying stage, the driver 3000 controls the adjuster 2000 to move away from the first air inlet 1111. In this case, the first air inlet 1111 is in an open state, and the air in the inner tub may enter the air exhaust duct 1001 through the first air inlet 1111 and be exhausted. When the air exhaust device is not required to draw and exhaust the air from the inner tub, for example, when the dish washing machine is in a washing stage, the driver 3000 controls the adjuster 2000 to move towards the first air inlet to block the first air inlet 1111. In this case, the first air inlet 1111 is in a closed state, and the air in the inner tub is not prone to enter the air exhaust duct 1001 through the first air inlet 1111. In particular, when the dish washing machine is in the washing stage, the high-temperature and high-humidity air in the inner tub is blocked by the adjuster 2000 and is not prone to enter the air exhaust duct 1001 through the first air inlet 1111 and leak out. In this way, safety is improved.

In another exemplary embodiment of the present disclosure, in order to improve a sealing effect of the adjuster 2000 on the first air inlet 1111 as much as possible, the adjuster 2000 is designed to be elastically deformed when the adjuster 2000 blocks the first air inlet 1111. The adjuster 2000 moves away from the first air inlet 1111 driven by the driver 3000. In this case, the first air inlet 1111 is in an open state, and the adjuster 2000 is in a non-deformed state. The adjuster 2000 moves towards the first air inlet 1111 under the driving of the driver 3000 until the first air inlet 1111 is blocked. Then, the adjuster 2000 is elastically deformed under the continued driving of the driver 3000, that is, the driver 3000 provides force for the elastic deformation of the adjuster 2000. As a result, the adjuster 2000 is tightly abutted against the first air inlet 1111, avoiding formation of a small gap between the adjuster 2000 and the first air inlet 1111. In this way, the sealing effect is effectively improved to prevent leakage of steam in the inner tub.

It can be understood that the adjuster 2000 may be elastically deformed partially or entirely.

For example, the adjuster 2000 includes a blocker 2100 and a seal portion 2300 disposed at the blocker 2100. The driver 3000 drives the blocker 2100 to move, and the blocker 2100 in turn drives the seal portion 2300 to be abutted against the first air inlet 1111. In this case, the blocker 2100 presses the seal portion 2300 tightly against the first air inlet 1111 to enable the seal portion 2300 to be elastically deformed.

In another embodiment of the present disclosure, the adjuster 2000 includes a blocker 2100 and a seal portion 2300 disposed at the blocker 2100. When the driver 3000 drives the blocker 2100 to move, the blocker 2100 in turn drives the seal portion 2300 to be abutted against the first air inlet 1111, to enable the seal portion 2300 to be elastically deformed. The blocker 2100 is also elastically deformed under the further driving of the driver 3000, and further presses the seal portion 2300 tightly against the first air inlet 1111. In this way, the sealing effect is improved.

The adjuster 2000 has a first end 2001 and a second end 2002 spaced apart from each other. When the adjuster 2000 moves towards the first air inlet 1111 to enable the first end 2001 to abut with the first air inlet 1111, the second end 2002 continues to move towards the first air inlet 1111 under the driving of the driver 3000 to elastically deform the adjuster 2000 to block the first air inlet 1111.

It can be understood that when the adjuster 2000 blocks the first air inlet 1111, the sealing effect is affected by many factors, such as flatness of the adjuster 2000 and the first air inlet 1111, assembling accuracy between the adjuster 2000 and the first air inlet 1111, a structural arrangement of the adjuster 2000, an anti-aging characteristic of the adjuster 2000, and an action point of the force formed by the driver 3000 on the adjuster 2000, all of which may affect the sealing effect between the adjuster 2000 and the first air inlet 1111. Therefore, in this embodiment, by providing the first end 2001 and the second end 2002 of the adjuster 2000, when the driver 3000 drives the first end 2001 of the adjuster 2000 to be abutted against the first air inlet 1111, the second end 2002 may continue to move towards the first air inlet 1111. Thus, when the second end 2002 is tightly pressed against the first air inlet 1111, the first end 2001 may be more tightly pressed against the first air inlet 1111.

For example, the adjuster 2000 includes a blocker 2100 and a seal portion 2300 disposed at the blocker 2100. The first end 2001 and the second end 2002 are in contact with the first air inlet 1111 simultaneously under the driving of the driver 3000, that is, the seal portion 2300 of the first end 2001 and the seal portion 2300 of the second end 2002 are in contact with the first air inlet 1111 simultaneously. In this case, the first air inlet 1111 has been blocked by the adjuster 2000. A thickness of the seal portion 2300 of the first end 2001 is relatively small, while a thickness of the seal portion 2300 of the second end 2002 is relatively large. When the driver 3000 continues to drives the blocker 2100 to move, since the seal portion 2300 of the second end 2002 is thicker, the blocker 2100 corresponding to the second end 2002 can continue to move, enabling a greater deformation of the seal portion 2300 of the second end 2002. When the second end 2002 continues to move, it also causes the first end 2001 to be tightly pressed against the first air inlet 1111, enabling a deformation (a deformation quantity is smaller than a deformation quantity of the seal portion 2300 of the second end 2002) of the seal portion 2300 corresponding to the first end 2001. As a result, the adjuster 2000 effectively seals the first air inlet 1111. Furthermore, warping between the part of the adjuster 2000 far from the action point of the force formed by the driver 3000 on the adjuster 2000 and the first air inlet 1111 can be prevented, and formation of a gap is avoided.

Figure 7:
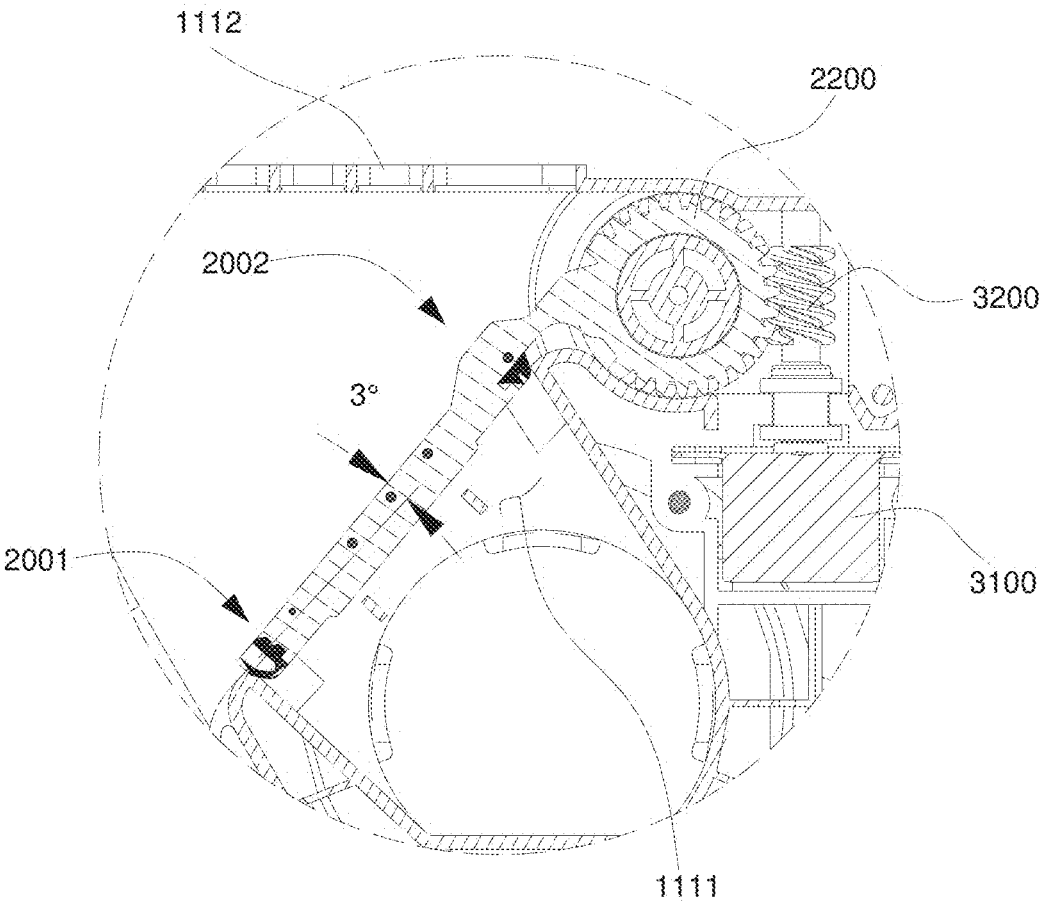
FIG. 7 is an enlarged view of the part shown by the dotted line in FIG. 6.

For another example, the adjuster 2000 includes a blocker 2100 and a seal portion 2300 disposed at the blocker 2100. The first end 2001 and the second end 2002 are in contact with the first air inlet 1111 sequentially under the driving of the driver 3000. The first end 2001 first abuts with the first air inlet 1111, and then the second end 2002 abuts with the first air inlet 1111 under the further driving of the driver 3000. That is, the seal portion 2300 of the first end 2001 is first abutted against the first air inlet 1111, and then the seal portion 2300 of the second end 2002 is abutted against the first air inlet 1111. In this way, the blocking of the first air inlet 1111 is achieved. For example, upon the first end 2001 being in contact with the first air inlet 1111, the adjuster 2000 and the first air inlet 1111 are not parallel to each other, but form a predetermined angle therebetween, which may be 1°, 3°, 5°, or 8° (3° as shown in FIG. 7), and can be set in accordance with practical conditions. In this way, the elastic deformation may occur between the first end 2001 and the second end 2002, effectively ensuring the sealing effect of each of the first end 2001 and the second end 2002. Thus, the sealing effect of the entire adjuster 2000 on the first air inlet 1111 is ensured, and furthermore, the warping between the part of the adjuster 2000 far from the action point of the force formed by the driver 3000 on the adjuster 2000 and the first air inlet 1111 can be prevented, and the formation of the gap is avoided. In other embodiments of the present disclosure, the thicknesses of the first end 2001 differs from the thickness of the second end 2002, and therefore the first end 2001 abuts with the first air inlet 1111 before the second end 2002 abuts with the first air inlet 1111.

As described above, it can be seen that in the technical solutions of the present disclosure, the housing 1000 and the adjustment mechanism are provided. The housing 1000 has the air exhaust duct 1001 and the first air inlet 1111. The first air inlet 1111 is in communication with the inner tub of the dish washing machine. When the dish washing machine is in the drying stage, the air in the inner tub may enter the air exhaust duct 1001 through the first air inlet 1111 and then be exhausted to dry the tableware. The adjustment mechanism includes the adjuster 2000 and the driver 3000. The driver 3000 drives the adjuster 2000 to move to block the first air inlet 1111. The adjuster 2000 is elastically deformed under the action of the driver 3000 when the adjuster 2000 blocks the first air inlet 1111, thereby improving the sealing effect of the first air inlet 1111. When the dish washing machine is in the washing stage, the high-temperature and high-humidity air in the inner tub cannot enter the air exhaust duct 1001 through the first air inlet 1111 and leak to the external environment.

Figure 6:
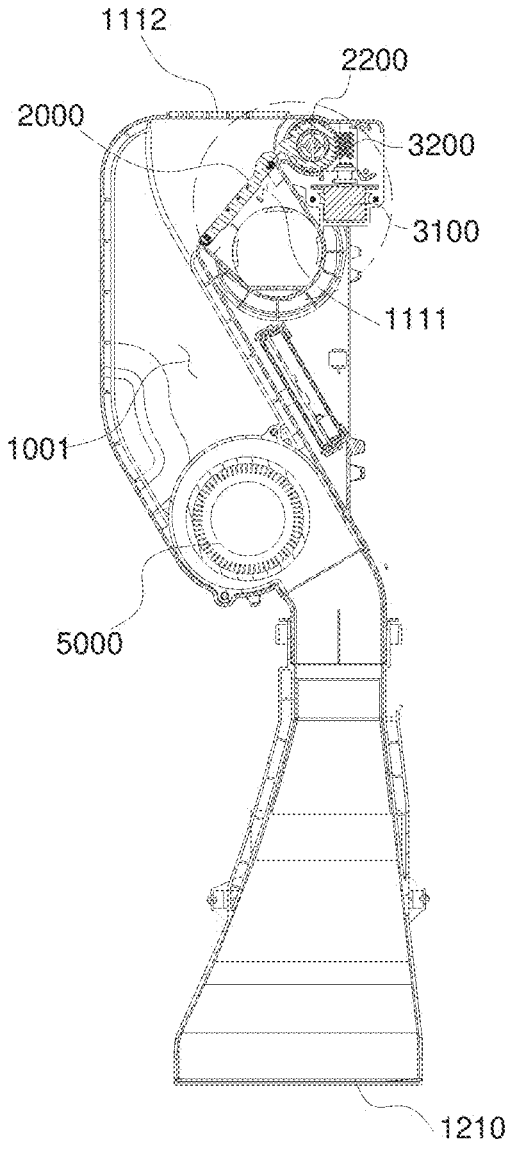
FIG. 6 is a partial cross-sectional view of an air exhaust device according to some embodiments (a cross section is parallel to the air exhaust device).

As shown in FIG. 6 and FIG. 7, in some embodiments, in order to facilitate the deformation of the adjuster 2000, the adjuster 2000, along its length direction, is elastically deformed in a process of blocking the first air inlet by the adjuster 2000.

That is, the adjuster 2000 has a predetermined length and is in an elongated structure as a whole. Thus, when the driver 3000 applies force to the adjuster 2000, the adjuster 2000 is more likely to be deformed. For example, the adjuster 2000 includes a blocker 2100 and a seal portion 2300 disposed at the blocker 2100. The seal portion 2300 is disposed in a length direction of the blocker 2100. When the driver 3000 drives the blocker 2100 to move to allow the seal portion 2300 to seal the first air inlet 1111, the driver 3000 continues to drive the blocker 2100 to allow the blocker 2100 to be pressed against the seal portion 2300. In this case, each part of the seal portion 2300 in a length direction of the seal portion 2300 is elastically deformed (that is, the seal portion 2300 is elastically deformed in the length direction of the seal portion 3000). In this way, the first air inlet 1111 is effectively sealed, and a motor 3100 can also continue to drive the blocker 2100 until each part of the blocker 2100 in the length direction of the blocker 2100 is elastically deformed.

Since the adjuster 2000 is designed to be elastically deformed in the length direction of the adjuster 2000, the driver 3000 is subjected to relatively less resistance than the adjuster 2000 elastically deformed in other directions of the adjuster 2000, thereby reducing design difficulty of the driver 3000. Furthermore, since the elastic deformation of the adjuster 2000 is achieved under the force of the driver 3000, transmission cooperation difficulty between the driver 3000 and the adjuster 2000 can be reduced. Therefore, a space occupied by the driver 3000 is reduced. as a result, the air exhaust device can be made thinner.

In combination with FIG. 7, in some embodiments, the adjuster 2000 has a contact portion driven by and connected with the driver 3000, that is, the contact portion constitutes an action point of the force of the driver 3000 on the adjuster 2000. The first end 2001 and the second end 2002 are located at one side of the contact portion, and the second end 2002 is closer to the contact portion than the first end 2001.

For example, the adjuster 2000 is provided with a gear portion 2200, and the driver 3000 and the gear portion 2200 are meshed for driving to enable the adjuster 2000 to rotate within a predetermined angle range. In this way, the gear portion 2200 is constructed as the contact portion. In other embodiments of the present disclosure, the driver 3000 is connected to the adjuster 2000 to drive the adjuster 2000 to reciprocate linearly, then a connection point between the adjuster 2000 and the driver 3000 is constructed as the contact portion.

The adjuster 2000 provided with a gear portion 2200 is taken as an example for illustration. The adjuster 2000 includes a blocker 2100 and a seal portion 2300 disposed at the blocker 2100. The blocker 2100 is provided with a gear portion 2200. The driver 3000 and the gear portion 2200 are meshed for driving, and the gear portion 2200 is constructed as the contact portion. The second end 2002 is closer to the gear portion 2200 and the first end 2001 is away from the gear portion 2200. The driver 3000 drives the gear portion 2200 to rotate. Since the second end 2002 is closer to the driver 3000 and the first end 2001 is far away from the gear portion 2200, a gap is easily formed between the first end 2001 and the first air inlet 1111. Therefore, while the first end 2001 abuts with the first air inlet 1111, by further driving the second end 2002 to move, the adjuster 2000 is elastically deformed, thereby eliminating the gap between the first end 2001 and the first air inlet 1111 as much as possible, ensuring the sealing effect, especially by the first end 2001 abutting with the first air inlet 1111 before the second end 2002 abutting with the first air inlet 1111, the sealing effect is better.

As shown in FIG. 7, in some embodiments, upon the adjuster 2000 being in contact with the first air inlet 1111, that is, when the adjuster 2000 rotates under the action of the driver 3000 to enable the first end 2001 to be just in contact with the first air inlet 1111, an angle is formed between an extending direction of the adjuster 2000 and an extending direction of the first air inlet 1111 (an angle shown is 3°). Since the angle is formed between the extending direction of the adjuster 2000 and the extending direction of the first air inlet 1111, the adjuster 2000 may be designed to be more symmetrical, avoiding the first end 2001 having a large thickness and the second end 2002 having a small thickness, or the first end 2001 having a small thickness and the second end 2002 having a large thickness. As a result, elastic performance of the adjuster 2000 is better, to prevent the adjuster 2000 from breaking during the elastic deformation.

Figure 8:
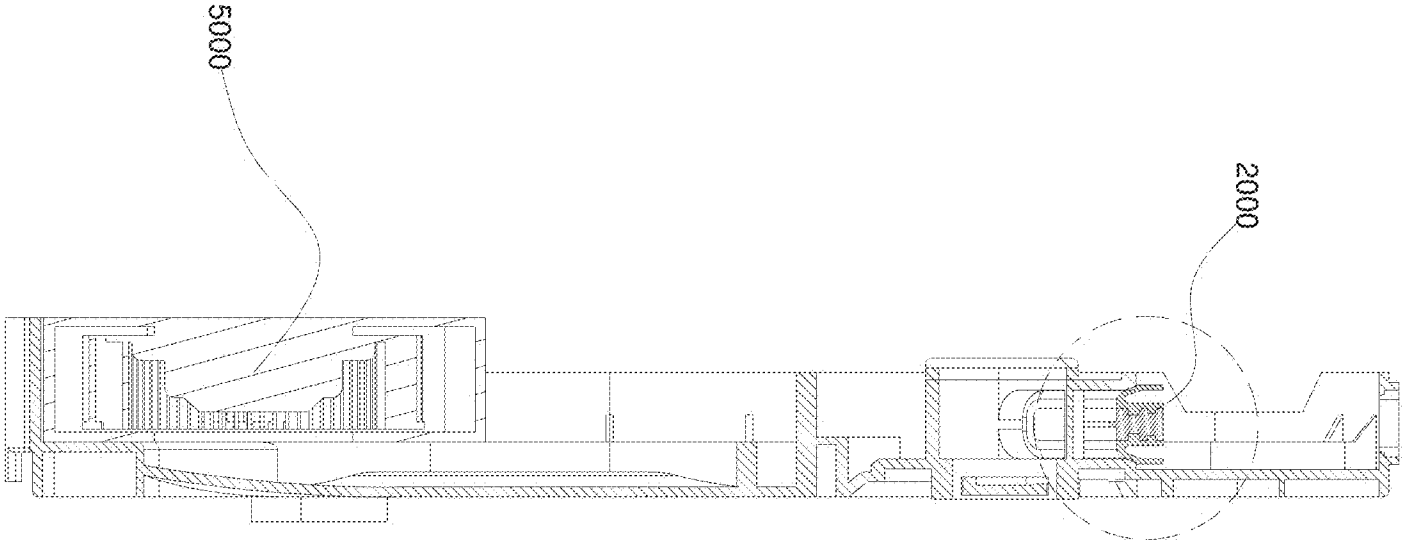
FIG. 8 is a partial cross-sectional view of an air exhaust device according to some embodiments (a cross section is perpendicular to the air exhaust device).
Figure 9:
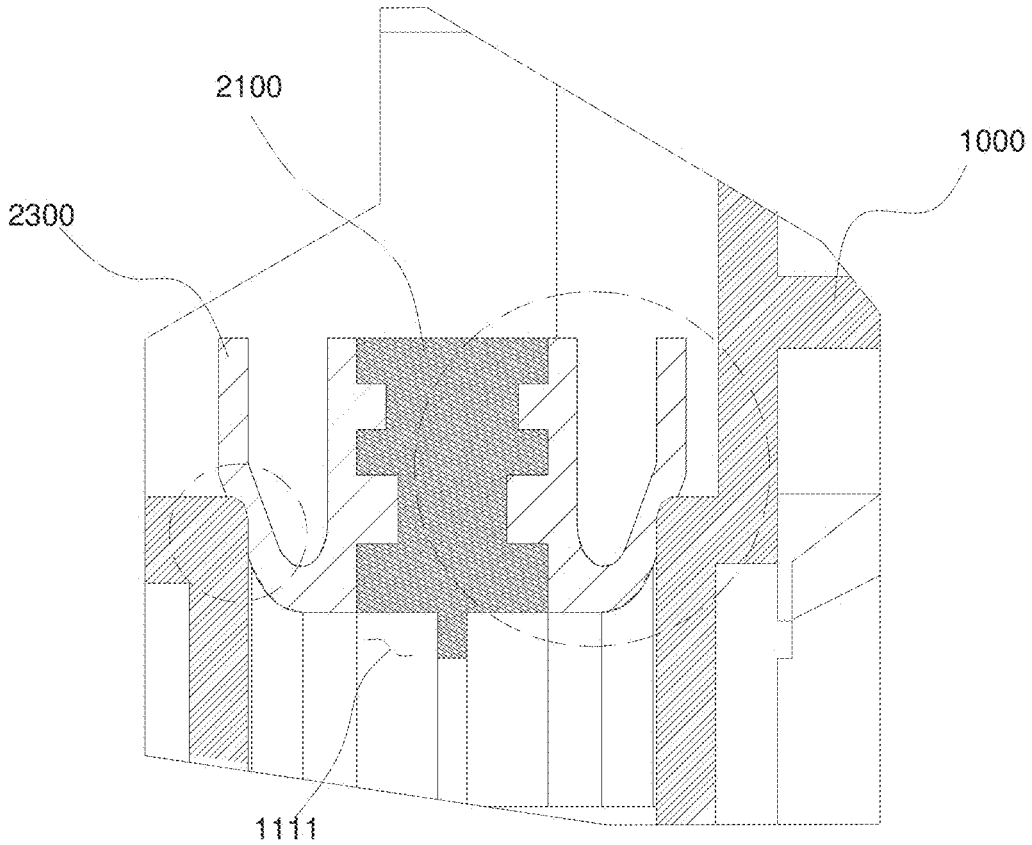
FIG. 9 is an enlarged view of the part shown by the dotted line in FIG. 8.
Figure 10:
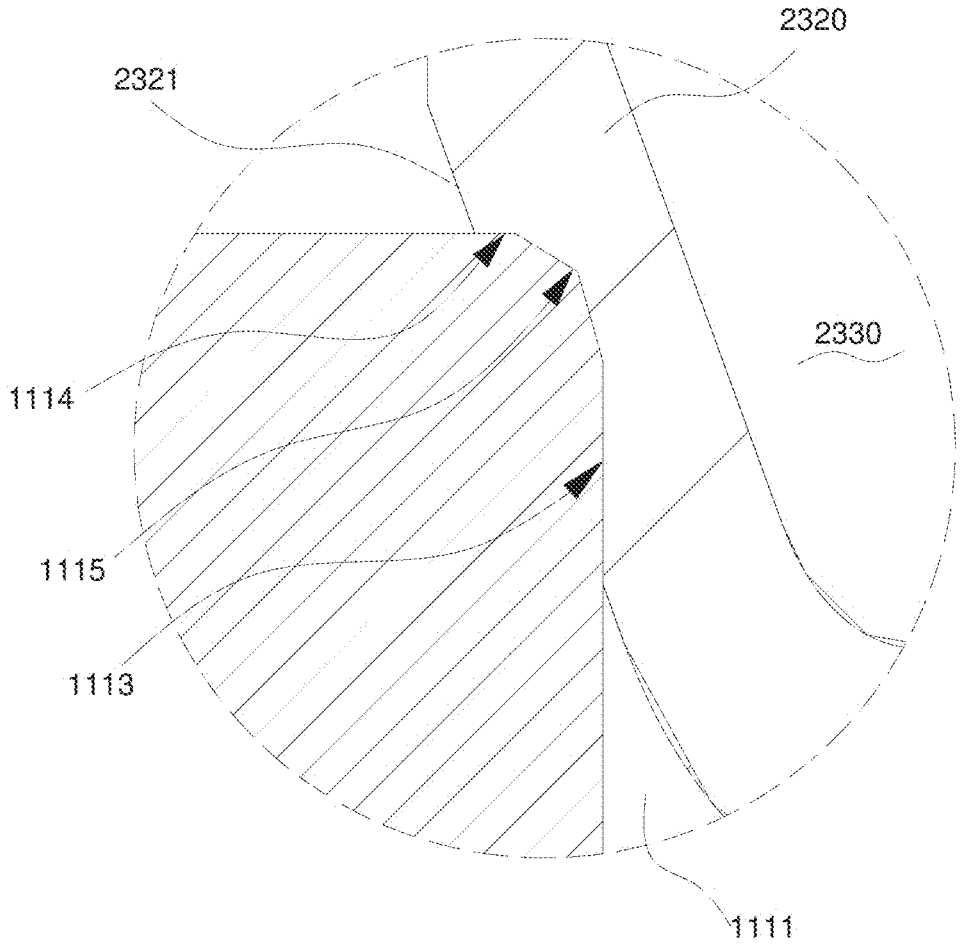
FIG. 10 is an enlarged view of one of the parts shown by the dotted lines in FIG. 9.

As shown in FIG. 8 to FIG. 10, in some embodiments, in order to further improve sealing reliability of the adjuster 2000 against the first air inlet 1111, the adjuster 2000 includes a blocker 2100 and a seal portion 2300 connected to the blocker 2100. The blocker 2100 is driven by and connected with the driver 3000, and the seal portion 2300 has a contact surface 2321. The contact surface 2321 of the seal portion 2300 abuts with an edge 1115 of the first air inlet 1111 to allow for line-surface contact sealing. In this way, uniformity of the sealing position is improved, and the sealing effect is greatly improved.

For example, the seal portion 2300 is disposed in the length direction of the blocker 2100 and surrounds a periphery of the blocker 2100. When the driver 3000 drives the blocker 2100 to move, the blocker 2100 drives the seal portion 2300 to block the first air inlet 1111. Since the seal portion 2300 has the contact surface 2321, when the contact surface 2321 abuts with the edge of the first air inlet 1111, a line-surface contact is formed between the contact surface 2321 and the edge 1115 of the first air inlet 1111, and relatively large force is generated between the contact surface 2321 and the edge 1115 of the first air inlet 1111. In this way, the entire first air inlet 1111 can be effectively sealed. Since an area of the contact surface 2321 is much larger than the edge 1115 of the first air inlet 1111, cooperation accuracy between the adjuster 2000 and the first air inlet 1111 can be reduced without affecting the sealing of the first air inlet 1111. In particular, when the adjuster 2000 blocks the first air inlet 1111 and is deformed under the further driving of the driver 3000 (the blocker 2100 is deformed), the seal portion 2300 may be deformed to contact an inner wall 1113 and an outer wall 1114 of the first air inlet 1111 simultaneously. In this way, the sealing reliability is improved.

Figure 11:
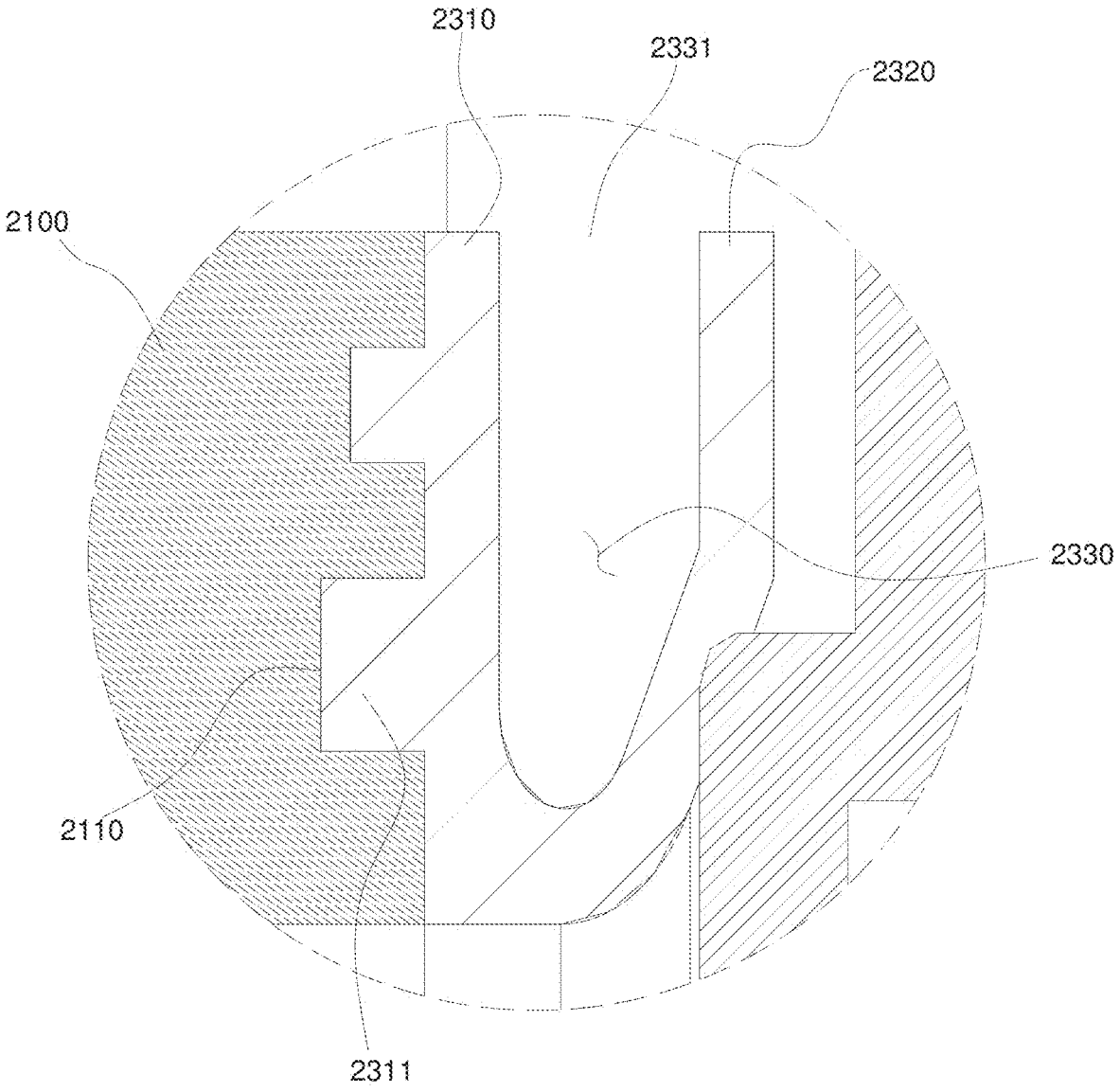
FIG. 11 is an enlarged view of another one of the parts shown by the dotted lines in FIG. 9.

As shown in FIG. 11, in some embodiments, the seal portion 2300 includes an outer layer 2320 and an inner layer 2310. A cavity 2330 is formed between the outer layer 2320 and the inner layer 2310, the inner layer 2310 is fixed at the blocker 2100, and the outer layer 2320 has the contact surface 2321. When the adjuster 2000 blocks the first air inlet 1111, the outer layer 2320 abuts with the first air inlet 1111 and is deformed, thereby the outer layer 2320 is compressed towards the inner layer 2310. In this case, the cavity 2330 becomes smaller. By defining the cavity 2330, a deformation quantity of the seal portion 2300 is effectively increased to ensure the sealing effect.

For example, the inner layer 2310 is disposed at the periphery of the blocker 2100, the outer layer 2320 and the inner layer 2310 are integrally formed, and the outer layer 2320 surrounds the inner layer 2310. Thus, the cavity 2330 of an annular shape is formed between the inner layer 2310 and the outer layer 2320. When the adjuster 2000 is abutted against the first air inlet 1111, the contact surface 2321 of the outer layer 2320 comes into contact with the edge 1115 of the first air inlet 1111, and then the outer layer 2320 is deformed towards the inner layer 2310. The outer layer 2320 has a relatively large deformation quantity by defining the cavity 2330, and therefore the deformation of the outer layer 2320 effectively eliminates the gap between the outer layer 2320 and the first air inlet 1111 when the outer layer 2320 abuts with the first air inlet 1111. In this way, the sealing effect is improved. It is precisely because the deformation quantity of the outer layer 2320 is relatively large that when the contact surface 2321 of the outer layer 2320 is in contact with the edge 1115 of the first air inlet 1111, the outer layer 2320 is more likely to be deformed towards two sides thereof with the part of the outer layer 2320 in contact with the edge 1115 of the first air inlet 1111 as a center to seal other parts of the first air inlet 1111 (the inner wall 1113 and the outer wall 1114 of the first air inlet 1111). In this way, a seal contact area is increased and the sealing effect is ensured.

Figure 14:
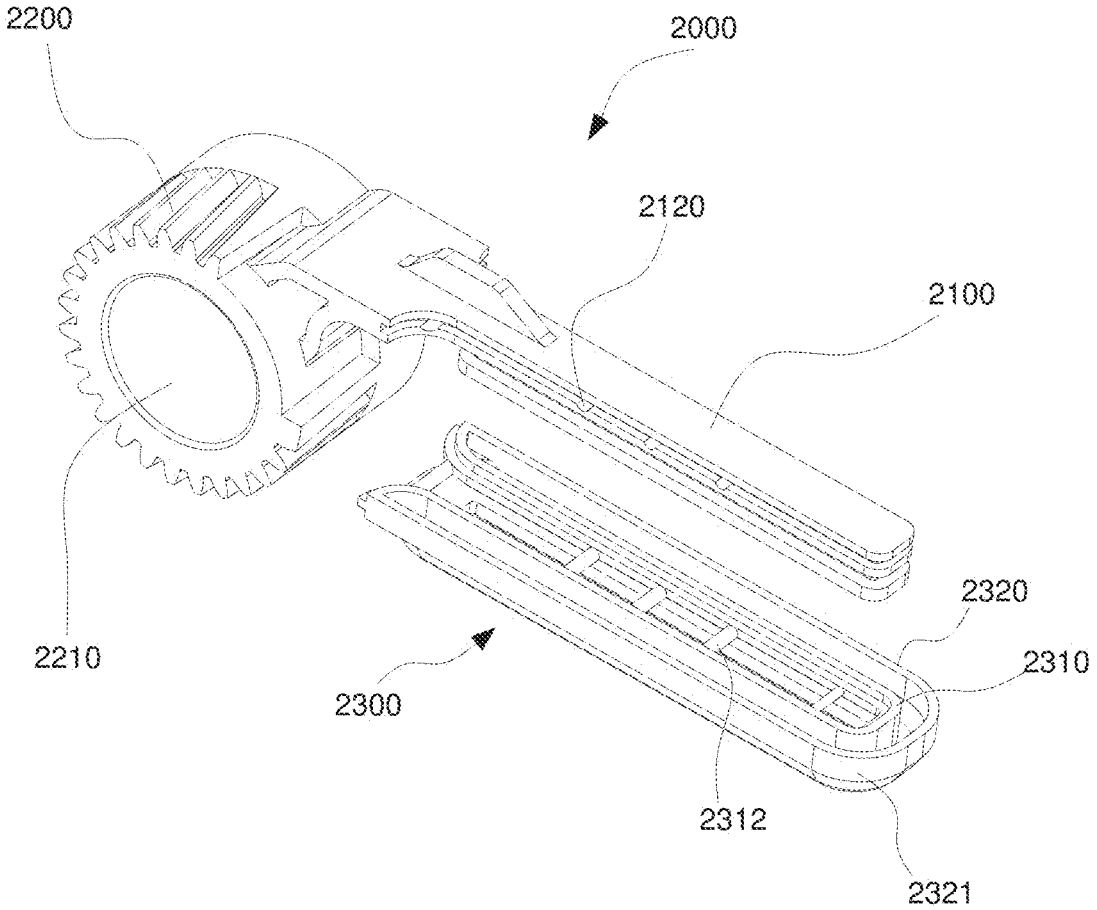
FIG. 14 is a schematic view of a structure of an adjuster according to some embodiments.

As shown in FIG. 11 and FIG. 14, in some embodiments, an opening 2331 in communication with the cavity 2330 is formed between the outer layer 2320 and the inner layer 2310, and the opening 2331 is oriented to face away from the first air inlet 1111. In this way, when the adjuster 2000 moves towards the first air inlet 1111 under the driving of the driver 3000, it can ensure that at least part of the contact surface 2321 of the outer layer 2320 is engaged into the first air inlet 1111 and forms a line-surface contact with the edge 1115 of the first air inlet 1111. When the opening 2331 faces towards the first air inlet 1111, during the movement of the adjuster 2000, the outer layer 2320 may not be completely aligned with the first air inlet 1111 and thus engaged into the first air inlet 1111, and then warping occurs, leading to a gap. In this embodiment, the opening 2331 is oriented to face away from the first air inlet 1111, which can also reduce the assembling accuracy requirements between the adjuster 2000 and the first air inlet 1111.

When the adjuster 2000 blocks the first air inlet 1111, the blocker 2100 drives the seal portion 2300 to be squeezed against the first air inlet 1111. In order to prevent the seal portion 2300 from separating from the blocker 2100, the blocker 2100 and the seal portion 2300 are prepared through two-shot injection molding, thereby enhancing the performance of the adjuster 2000 and preventing the seal portion 2300 from separating from the blocker 2100. The two-shot injection molding is specifically as follows. A blocker 2100 is first molded in a mold, and the blocker 2100 is put into a secondary molding mold, and then injected with a corresponding material to form a seal portion 2300. In this way, the blocker 2100 and the seal portion 2300 are bonded together.

In order to enhance a bonding strength between the blocker 2100 and the seal portion 2300, one of the inner layer 2310 and the blocker 2100 has a recess 2110, and the other one of the inner layer 2310 and the blocker 2100 is provided with a protrusion 2311, and the protrusion 2311 is engaged into the recess 2110. For example, the inner layer 2310 is of an annular structure, the protrusion 2311 is disposed at an inner side of the inner layer 2310, and the blocker 2100 has a recess 2110 at the periphery of the blocker 2100. Thus, during the two-shot injection molding, the protrusion 2311 formed at the inner layer 2310 may be engaged into the recess 2110, thereby enhancing the bonding strength between the blocker 2100 and the seal portion 2300. For another example, the blocker 2100 has a through groove 2120, and the inner layer 2310 is constructed into an annular structure and provided with a connecting rod portion 2312. The connecting rod portion 2312 is located in a space enclosed by the inner layer 2310, and the connecting rod portion 2312 is engaged into the through groove 2120.

Figure 12:
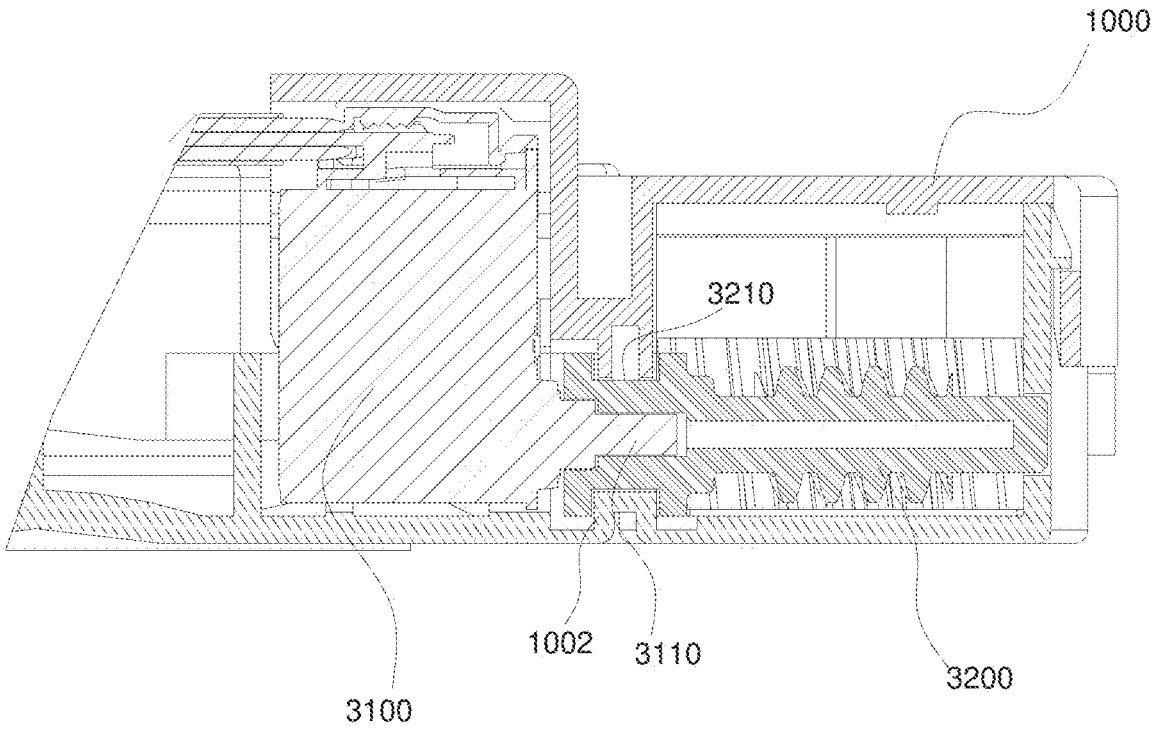
FIG. 12 is a schematic view of a driver structure mounted in a housing according to some embodiments.
Figure 13:
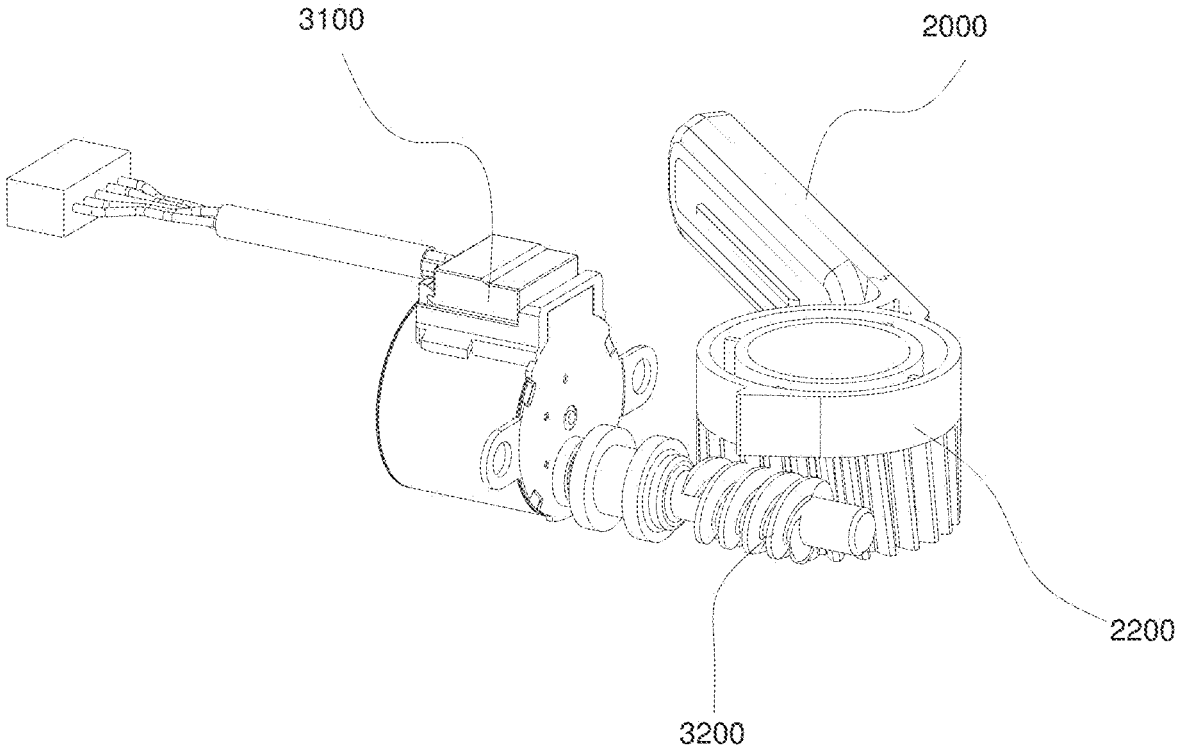
FIG. 13 is a schematic view of a drive connection between a driver and an adjuster according to some embodiments.

As shown in FIG. 7, FIG. 12, and FIG. 13, in some embodiments, in order to reduce complexity of the driving connection between the driver 3000 and the adjuster 2000 as much as possible, the adjuster 2000 is designed to rotate under the driving of the driver 3000, to facilitate the movements facing towards or away from the first air inlet 1111.

For example, the adjuster 2000 is provided with a gear portion 2200 (the gear portion 2200 and the blocker 2100 may be integrally formed), and the driver 3000 includes a worm 3200 and a motor 3100. The motor 3100 drives and is connected to the worm 3200, and the worm 3200 is meshed with the gear portion 2200. When the motor 3100 drives the worm 3200 to rotate, the worm 3200 drives the gear portion 2200 to rotate, which in turn drives the adjuster 2000 to move. As long as the motor 3100 is controlled to drive the worm 3200, the adjuster 2000 may rotate by a predetermined angle. As a result, the first air inlet 1111 has different opening degrees. Since the worm 3200 and the gear portion 2200 are meshed with each other for the transmission, a rotation axis of the worm 3200 and a rotation axis of the gear portion 2200 intersect in space, for example, are perpendicular to each other. When the motor 3100 is powered off, the adjuster 2000 is not easy to change its position. This is because if the adjuster 2000 is intended to rotate, it is necessary for the gear portion 2200 to rotate, which causes the worm 3200 to move in an axial direction of the worm 3200. However, since the worm 3200 is set to enable the movement in the axial direction of the worm 3200 to be constrained, for example, the worm 3200 is mounted in the housing 1000, and the housing 1000 constrains the worm 3200 to move in the axial direction of the worm 3200, but does not prevent the worm 3200 from rotating with the axial direction of the worm 3200 as the rotation axis. Therefore, the worm 3200 limits the rotation of the gear portion 2200, thereby limiting the movement of the adjuster 2000. As a result, the position of the adjuster 2000 can be well guaranteed when the motor 3100 is in a power-off state, and the motor 3100 does not need to remain powered on for a long time period.

In particular, when the motor 3100 drives the adjuster 2000 to block the first air inlet 1111 and is elastically deformed, even if the motor 3100 is powered off, the adjuster 2000 has a recovery trend. In addition, due to the mutual locking state of the gear portion 2200 and the worm 3200, the adjuster 2000 is still elastically deformed, ensuring the effect of the adjuster 2000 blocking the first air inlet 1111.

As shown in FIG. 12, in some embodiments, a rotation axis of the motor 3100 can be formed when the motor 3100 is operated, that is, the motor 3100 is a mechanism that can output rotational power. For example, the motor 3100 is a rotor motor, and the drive connection between the motor 3100 and the worm 3200 enables the rotation axes of the motor 3100 and the worm 3200 to be coaxial, that is, the rotation axis of the worm 3200 and the rotation axis of the motor 3100 are coaxially arranged. For example, the motor 3100 has a power output shaft 3110 capable of rotating in an axial direction of the power output shaft 3110 under the action of the motor 3100 to form a rotation axis, and the worm 3200 is fixedly arranged around the power output shaft 3110, and an axial direction of the worm 3200 is arranged in a same direction as the axial direction of the power output shaft. In this way, a number of transmission parts between the motor 3100 and the worm 3200 can be reduced, enabling more compact structure of the entire driver 3000, which reduces an occupied space.

As shown in FIG. 12, in some embodiments, the worm 3200 is mounted in the housing 1000, and the axial direction of the worm 3200 constitutes the rotation axis, the worm 3200 may be rotatably arranged relative to the housing 1000, but the worm 3200 is constrained in the axial direction of the worm 3200. In order to realize both the rotatable arrangement of the worm 3200 and the constrain of the movement of the worm 3200 in the axial direction of the worm 3200, one of the worm 3200 and the housing 1000 has a limit groove 3210, and the other one of the worm 3200 and the housing 1000 is provided with a limit protrusion 1002.

The worm 3200 having a limit groove 3210 and the housing 1000 provided with a limit protrusion 1002 are taken as an example for illustration. The worm 3200 has the limit groove 3210 arranged about a rotation axis of the worm 3200 to form a limit groove 3210 of an annular shape surrounding the axial direction of the worm 3200. Correspondingly, the housing 1000 is provided with a limit protrusion 1002 engaged into the limit groove 3210. Thus, when the worm 3200 rotates, the limit protrusion 1002 is into the limit groove 3210 but does not hinder the rotation of the worm 3200. However, when the worm 3200 moves in the axial direction of the worm 3200, the worm 3200 is hindered by the limit protrusion 1002.

As shown in FIG. 6 and FIG. 7, in some embodiments, the gear portion 2200 may be rotatably arranged in the housing 1000, that is, the gear portion 2200 is positioned by the housing 1000. Thus, when the motor 3100 drives the gear portion 2200 to rotate, the gear portion 2200 can drive the adjuster 2000 to rotate within a predetermined angle range. In this way, the mounting of the adjusting mechanism is simplified. In particular, when the motor 3100 drives the gear portion 2200 to rotate, the gear portion 2200 is subjected to a predetermined degree of force. Since the gear portion 2200 is positioned in the housing 1000 and a strength of the housing 1000 is relatively high, the gear portion 2200 rotates more stably.

For example, one of the gear portion 2200 and the housing 1000 is provided with a rotary shaft 1003, and the other one of the gear portion 2200 and the housing 1000 has a shaft hole 2210. The rotary shaft 1003 is engaged into the shaft hole 2210 to realize the rotatable arrangement of the gear portion 2200. The gear portion 2200 having a shaft hole 2210 and the housing 1000 provided with a rotary shaft 1003 are taken as an example for illustration. The gear portion 2200 has an axial hole 2210 in the axial direction of the gear portion 2200, and the housing 1000 is provided with a rotary shaft 1003. Thus, when the gear portion 2200 is mounted into the housing 1000, the gear portion 2200 is arranged around the rotary shaft 1003 through the axial hole 2210, and the gear portion 2200 is positioned and fixed to a certain extent. Therefore, assembling of the air exhaust device is easier.

Figure 5:
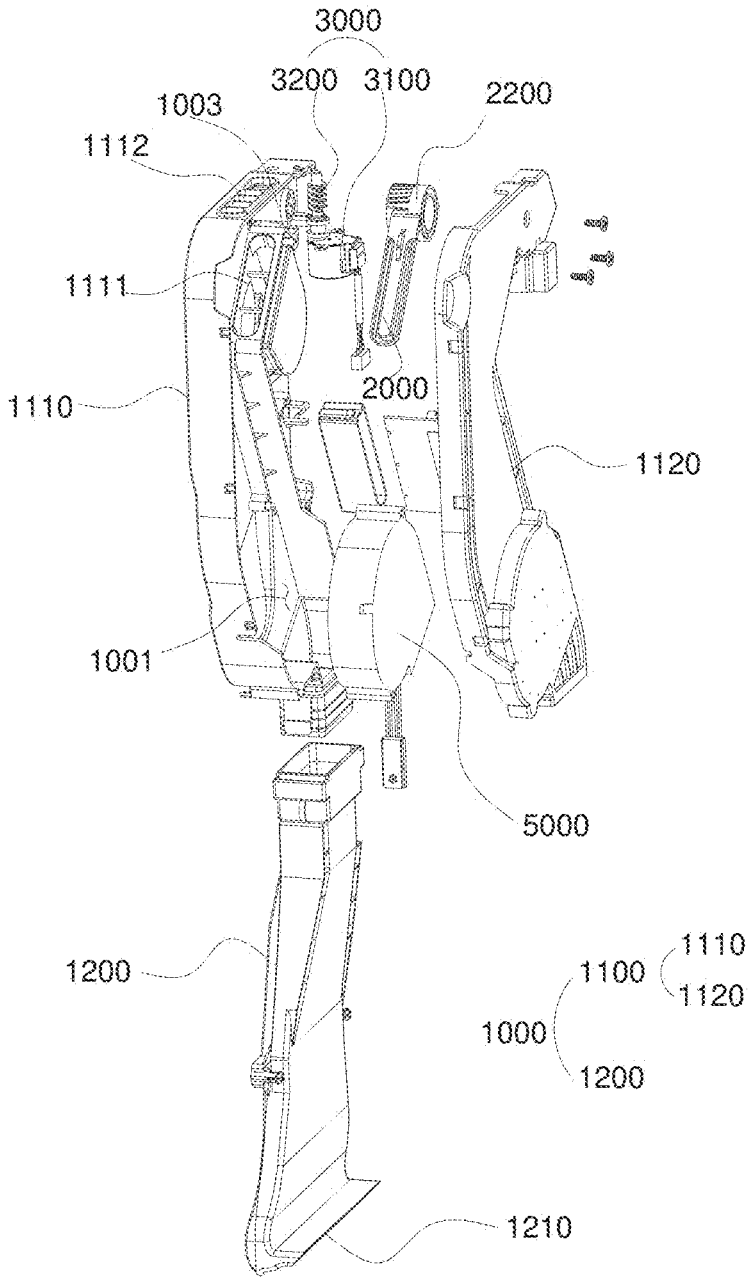
FIG. 5 is an exploded view of an air exhaust device according to some embodiments.

As shown in FIG. 5, in some embodiments, the housing 1000 includes a first housing 1100 formed as at least part of the air exhaust duct 1001. The first housing 1100 includes a first half housing 1110 and a second half housing 1120 connected to the first half housing 1110. The first half housing 1110 and the second half housing 1120 may be connected in a variety of manners, for example, welding, screwing, and snap-fit. By providing the first half housing 1110 and the second half housing 1120, the adjuster 2000 and the driver 3000 are conveniently mounted in the housing 1000.

In an exemplary embodiment of the present disclosure, in order to facilitate air transmission and meet various requirements of shape, performance, etc., the air exhaust duct 1001 has a predetermined length. In order to reduce manufacturing difficulty of the housing 1000, the housing 1000 is designed as a first housing 1100 and a second housing 1200. The first housing 1100 and the second housing 1200 are connected to each other to form the entire air exhaust duct 1001. The first air inlet 1111 is defined at the first housing 1100, and the air outlet 1210 is defined at the second housing 1200.

In addition, in order to facilitate the mounting of the adjustment mechanism, the first housing 1100 is designed as a first half housing 1110 and a second half housing 1120 that are connected to each other, and the second half housing 1120 and the first half housing 1110 are connected to each other to form at least part of the air exhaust duct 1001. The first half housing 1110 is provided with a rotary shaft 1003, and the gear portion 2200 may be arranged around the rotary shaft 1003. When the second half housing 1120 is connected to the first half housing 1110, the first half housing 1110 and the second half housing 1120 jointly clamp the gear portion 2200 to limit the gear portion 2200. Each of the first half housing 1110 and the second half housing 1120 is provided with a limit protrusion 1002. The limit protrusion 1002 of the first half housing 1110 interfaces with the limit protrusion 1002 of the second half housing 1120 to form the limit protrusion 1002 of the annular shape. In this way, the limit protrusion 1002 of the first half housing 1110 and the limit protrusion 1002 of the second half housing 1120 can clamp the worm 3200 together. The air blower 5000 may also be disposed between the first half housing 1110 and the second half housing 1120 for easy mounting. Therefore, flowing of an airflow is driven, allowing air to flow into the air exhaust duct 1001 from the first air inlet 1111.

Combined with FIG. 6 and FIG. 7, in some embodiments, the housing 1000 is further provided with a second air inlet 1112 in communication with the air exhaust duct 1001. The second air inlet 1112 is configured to introduce external air. The adjuster 2000 is movable towards the first air inlet 1111 and the second air inlet 1112 under the driving of the driver 3000. In this way, a proportion of air flowing into the air exhaust duct 1001 from the first air inlet 1111 to air flowing into the air exhaust duct 1001 from the second air inlet 1112 may be adjusted, which facilitates improving drying efficiency.

In an exemplary embodiment of the present disclosure, the housing 1000 has a first air inlet 1111 and a second air inlet 1112, and the adjuster 2000 is movable towards the first air inlet 1111 and the second air inlet 1112. That is, the adjuster 2000 is away from the second air inlet 1112 when the adjuster 2000 moves towards the first air inlet 1111, and the adjuster 2000 is away from the first air inlet 1111 when the adjuster 2000 moves towards the second air inlet 1112. It can be understood that when the adjuster 2000 moves towards the first air inlet 1111, an opening degree of the first air inlet 1111 gradually decreases until the adjuster 2000 completely blocks the first air inlet 1111, and correspondingly, an opening degree of the second air inlet 1112 gradually increases until the second air inlet 1112 is fully opened. When the adjuster 2000 moves towards the second air inlet 1112, an opening degree of the second air inlet 1112 gradually decreases until the adjuster 2000 completely blocks the second air inlet 1112, and correspondingly, an opening degree of the first air inlet 1111 gradually increases until the first air inlet 1111 is fully opened.

When the air exhaust duct 1001 is not operating, that is, when the dish washing machine does not need to dry the inner tub, the adjuster 2000 is in a state of blocking the first air inlet 1111 to prevent high-temperature and high-humidity steam in the inner tub from entering the air exhaust duct 1001 and leaking to the external environment.

When the air exhaust duct 1001 starts operating, that is, when the dish washing machine needs to dry the inner tub, due to high humidity of the air in the inner tub, the dish washing machine controls the driver 3000 to activate to drive the adjuster 2000 to rotate to an approximately middle position between the first air inlet 1111 and the second air inlet 1112. In this case, the air blower 5000 not only draws the air from the inner tub through the first air inlet 1111, but also draws the external air through the second air inlet 1112. The two air streams are mixed in the air exhaust duct 1001, to prevent a large amount of condensed water in the external environment caused by air exhausting of the air exhaust duct 1001 as well as rapid heat loss of the inner tub. Thus, the drying efficiency is improved.

It can be understood that during the operation of the air exhaust device, the adjuster 2000 can be driven to rotate in real time based on humidity of the mixed air (with a corresponding humidity sensor), to adjust the opening degree of each of the first air inlet 1111 and the second air inlet 1112 and control a proportion of the mixed air. Thus, the drying effect is optimized. For example, in a later stage of drying, the adjuster 2000 may completely block the second air inlet 1112 when the humidity is low. In this way, the air blower 5000 may fully draw and exhaust the air from the inner tub to speed up the drying efficiency. After the drying is completed, the adjuster 2000 may be controlled to rotate to block the first air inlet 1111.

The above are only preferred embodiments of the present disclosure, and do not limit the patent scope of the present disclosure. Under the concept of the present disclosure, equivalent structural transformations made by using the contents of the description and the drawings of the present disclosure, or directly/indirectly applied in other related arts are included in the patent protection scope of the present disclosure.

What is claimed is:

1. An air exhaust device, comprising:

a housing having an air exhaust duct and a first air inlet in communication with the air exhaust duct, the first air inlet being in communication with an inner tub of a dish washing machine; and an adjustment mechanism comprising an adjuster and a driver driving and connected to the adjuster, the adjuster being movable towards or away from the first air inlet driven by the driver, and the adjuster having a first end and a second end that are spaced apart from each other;

when the adjuster moves towards the first air inlet and the first end abuts with the first air inlet, the second end continues to move towards the first air inlet to elastically deform the adjuster to block the first air inlet.

2. The air exhaust device according to claim 1, wherein the adjuster, along its length direction, is elastically deformed in a process of blocking the first air inlet by the adjuster.

3. The air exhaust device according to claim 1, wherein the first end abuts with the first air inlet before the second end abuts with the first air inlet in the process of blocking the first air inlet by the adjuster.

4. The air exhaust device according to claim 1, wherein the adjuster has a contact portion driven by and connected with the driver, the first end and the second end being located at one side of the contact portion, and the second end being closer than the first end to the contact portion.

5. The air exhaust device according to claim 1, wherein an angle is formed between an extending direction of the adjuster and an extending direction of the first air inlet upon the adjuster being in contact with the first air inlet.

6. The air exhaust device according to claim 1, wherein the driver is configured to drive the adjuster to rotate.

7. The air exhaust device according to claim 6, wherein:

the adjuster is provided with a gear portion; and the driver comprises a motor and a worm, the motor being configured to drive the worm to rotate, and the worm being configured to drive the adjuster to rotate by meshing with the gear portion.

8. The air exhaust device according to claim 7, wherein a rotation axis of the motor formed when the motor is operated is coaxial with a rotation axis of the worm.

9. The air exhaust device according to claim 7, wherein:

the worm is disposed at the housing;

one of the worm and the housing has a limit groove; and the other one of the worm and the housing is provided with a limit protrusion, the limit protrusion being engaged into the limit groove to restrict a movement of the worm in an axial direction of the worm.

10. The air exhaust device according to claim 7, wherein the gear portion is rotatably connected to the housing.

11. The air exhaust device according to claim 10, wherein:

one of the gear portion and the housing is provided with a rotatory shaft; and the other one of the gear portion and the housing has a shaft hole, the rotatory shaft being engaged into the shaft hole.

12. The air exhaust device according to claim 7, wherein the housing comprises a first half housing and a second half housing connected to the first half housing, at least part of the air exhaust duct being formed by the first half housing and the second half housing, and the adjuster and the driver being disposed between the first half housing and the second half housing.

13. The air exhaust device according to claim 1, wherein the adjuster comprises:

a blocker driven by and connected with the driver; and a seal portion disposed at the blocker, the seal portion having a contact surface, wherein in a process of blocking the first air inlet by the adjuster, the contact surface abuts with an edge of the first air inlet, and the blocker and/or the seal portion are elastically deformed.

14. The air exhaust device according to claim 13, wherein the seal portion comprises an inner layer and an outer layer, a cavity being formed between the inner layer and the outer layer, the inner layer being fixed to the blocker, and the outer layer having the contact surface.

15. The air exhaust device according to claim 14, wherein an opening in communication with the cavity is formed between the inner layer and the outer layer, the opening being oriented to face away from the first air inlet.

16. The air exhaust device according to claim 14, wherein:

one of the blocker and the inner layer has a recess, and the other one of the blocker and the inner layer is provided with a protrusion, the protrusion being engaged into the recess; and/or the blocker has a through groove, the inner layer is constructed into an annular structure and provided with a connecting rod portion, the connecting rod portion being located within a space enclosed by the inner layer, and the connecting rod portion being engaged into the through groove.

17. The air exhaust device according to claim 13, wherein the seal portion and the blocker are formed by two-shot injection molding.

18. The air exhaust device according to claim 1, wherein:

the housing further has a second air inlet in communication with the air exhaust duct, the second air inlet being configured to introduce external air, and the adjuster being movable towards the first air inlet and the second air inlet under the driving of the driver; and the air exhaust device further comprises an air blower disposed in the air exhaust duct.

19. A dish washing machine, comprising the air exhaust device according to claim 1.

* * * * *